US006155415A

United States Patent [19]

Runyan

[11] Patent Number: 6,155,415

[45] Date of Patent: Dec. 5, 2000

[54] GARMENT BOX

[76] Inventor: Shawn Runyan, 18051 Joyful La., No. 105, Huntington Beach, Calif. 92648

[21] Appl. No.: 09/303,479

[22] Filed: Apr. 30, 1999

[51] Int. Cl.[7] ..... B65D 85/18

[52] U.S. Cl. ..... 206/279; 206/280; 206/289; 206/290; 229/167; 229/178

[58] Field of Search ..... 229/178, 165, 229/166, 167, 194, 195; 206/279, 278, 288, 289, 290, 297

[56] References Cited

U.S. PATENT DOCUMENTS

| | | | |
|---|---|---|---|
| 1,494,531 | 5/1924 | Corcoran . | |
| 1,731,996 | 10/1929 | Appelbaum . | |
| 1,776,134 | 9/1930 | Scruby . | |
| 1,843,547 | 2/1932 | Dukes . | |
| 2,308,818 | 1/1943 | Levkoff | 229/194 X |
| 2,389,703 | 11/1945 | Van Rosen | 229/167 |
| 2,675,166 | 4/1954 | Main | 229/167 |
| 2,811,296 | 10/1957 | Long | 229/194 X |
| 2,883,042 | 4/1959 | Richer . | |
| 3,002,672 | 10/1961 | Kotowick | 229/167 X |
| 3,999,657 | 12/1976 | Doskocil . | |
| 4,060,169 | 11/1977 | Hildebrand . | |
| 4,158,406 | 6/1979 | Feder . | |
| 4,318,472 | 3/1982 | Nauheimer . | |
| 4,342,389 | 8/1982 | Bethune . | |
| 4,416,371 | 11/1983 | Nauheimer . | |
| 5,857,612 | 1/1999 | Smith et al. | 229/167 |

OTHER PUBLICATIONS

U.S. patent No. 4,773,533 issued Sep. 27, 1988 to Greene.

*Primary Examiner*—Stephen P. Garbe
*Assistant Examiner*—Tri M. Mai
*Attorney, Agent, or Firm*—Stephen Donovan

[57] ABSTRACT

A garment box comprising bottom panels, top panels, two side walls and two end walls with a double walled clothes hanger head enclosure parallel to each end wall of the garment box is disclosed. The clothes hanger head enclosure comprises three interlocking panels, a reinforcing wall and a spacing wall which walls help to maintain the integrity and dimensions of the clothes hanger head enclosure during handling and shipment of the garment box.

11 Claims, 8 Drawing Sheets

GARMENT BOX

BACKGROUND

The present invention relates to a foldable container, such as a garment box. In particular the present invention relates to a garment box for containing a product, such as a clothing item on a clothes hanger with secure retention of the head of the clothes hanger within a double walled enclosure element of the garment box.

Garments such as shirts, dresses, jackets, skirts, pants, etc can be shipped in a box with the clothing items already placed on clothes hangers. It is known that some means is required to secure the clothes hangers which bears the clothing in place within a garment box so that movement of the clothes hangers is restricted or prevented, otherwise the clothing can curl up and wrinkle. If the clothes hangers are free to move about, even though confined within a sealed garment box, the clothing can become wrinkled, disarranged, and disheveled. Furthermore, if lacking suitable restraining means, the head of a clothes hanger can, during handling and shipment of the garment box, insert itself, tear and/or score clothing items. Thus, attention in the art has been directed in the art to finding suitable means for anchoring the clothes hanger heads in a manner which still permits ready placement and packing of clothes hangers bearing clothing into the garment box and a facile removal of the clothes hangers bearing the clothing items by the recipient of the packed garment box.

The garment box disclosed by U.S. Pat. No. 4,060,169 provides an enclosure for a hanger within a garment box. The enclosure into which the clothes hanger fits is formed by folding over a single panel, a portion of which single panel is positioned under a strikeout or raised tab portion of a second fold over panel. Such an arrangement is inherently unstable and can come apart, freeing the clothes hangers during shipment, because the hanger enclosure used in the '169 patent lacks any bullock or supporting wall within the hanger enclosure and additionally, the hanger enclosure consists of a single, unsupported panel held in place by the small strikeout of a second panel which lies flat on the bottom of the '169 patent's garment box and which is not interlocked into the first fold over panel. Additionally, the garment box disclosed by the '169 patent inserts the heads of clothes hangers into the hollow behind the single walled enclosure by inserting the clothes hanger heads into large central opening at the top of a slot adjacent to a "tongue-like element." Unfortunately, the presence of such a large central opening in proximity to the heads of the clothes hangers considerably facilitates a displacement of the clothes hanger heads out of their retaining slot during handling and shipment of the packed garment box.

Furthermore, the '169 patent garment box lacks any reinforcing, spacing or bulwark walls to help maintain the shape and integrity of the enclosure for the clothes hanger heads during shipment and handling of the packed garment box. The garment container disclosed by U.S. Pat. No. 4,416,371 discloses a hollow end wall structure adapted to receive a plurality of garment hangers. Only that portion of the hanger head enclosure of the '371 patent in the immediate vicinity of the slot for receiving the heads of clothes hangers is double walled. Furthermore, the hanger head enclosure of the garment container disclosed by the '371 patent lacks any reinforcing, spacing or bulwark walls and has the same disadvantageous large, central opening at the same location and for the same purpose as present in the '169 patent.

Thus, while garment boxes with clothes hanger head enclosures are known, the existing garment boxes have many drawbacks and deficiencies. Known garment box hanger head enclosures lack means to obscure the entire hanger head from the clothing and lack sufficient or suitable hanger head enclosure reinforcement or spacer walls so that the enclosure can maintain its integrity during the rigors of handling and shipment, such as can occur during for an international clothing shipment where there are multiple traffic points and stresses forced upon the garment box.

What is needed therefor is a garment box suitable for shipping clothing in which garment box there is a clothes hanger head enclosure which can securely hold clothes hangers in place during shipment and transport of the garment box and which clothes hanger head enclosure can maintain its shape and integrity during the rigors of garment box handling and shipment.

SUMMARY

The present invention meets this need and provides a garment box with a clothes hanger head enclosure which can securely retain clothes hangers in place during handling and shipment and which clothes hanger head enclosure can maintain its shape and integrity during handling and shipment.

A garment box within the scope of the present invention can have a bottom wall formed by the juxtaposition of two foldable, bottom wall panels, a top wall formed by the juxtaposition of two foldable, top wall panels, two side walls disposed between and spacing apart the bottom wall and the top wall, and two end walls, each end wall being adjacent to and at right angles to the side walls. Parallel to and contiguous to at least one of the end walls there is a double walled enclosure into which the head or loop of a clothes hanger can be inserted and retained during handling and shipment of the garment box.

The double walled enclosure has a first fold over panel integral with a lower surface of the end wall. The first fold over panel can have a central, transverse slot.

The enclosure also has a second fold over panel integral with an upper surface of the end wall, and a third fold over panel integral with an upper surface of the end wall and adjacent to the second fold over panel. Interposition of the first, second and third fold over panels forms the double walled enclosure, The first panel runs essentially along the entire length of the end wall, so that the length of the first panel is approximately equal to the length of the end wall. The length of the second panel is equal to approximately one half of the length of the end wall, and the length of the third panel is equal to approximately one half of the length of the end wall. Significantly, the free end of each of the second and third panels bears a protruding tab.

The terminal section of the free end of the first panel is adapted to be folded over so as to form a first, longitudinal, spacing wall in the hanger enclosure. The first panel can further comprise a second, square, spacing wall located adjacent to the end of the first panel which is integral with the end wall. The second, square spacing wall can be formed as a push out tab by making a smaller slit in the first panel perpendicular to an inner portion of the central, transverse slot.

The diameters of both the first and second spacing walls are approximately equal. The spacing walls serve to determine the internal diameter of the hollow of the hanger head enclosure and to assist retention of the shape of the enclosure.

Notably, the first panel has two longitudinal slits on opposite sites of the central. transverse slot, and the protruding tab on the free end of each of the second and third panels is adapted to be inserted into its corresponding longitudinal slit on the first panel.

A detailed embodiment of a garment box within the scope of the present ,can have:

(a) a bottom wall formed by the juxtaposition of two foldable, bottom wall panels; (b) a top wall formed by the juxtaposition of two foldable, top wall panels; (c) two side walls disposed between and spacing apart the bottom wall and the top wall, and; (d) two end walls, each end wall being adjacent to and at right angles to the side walls and wherein parallel to and contiguous to at least one of the end walls there is disposed;

(e) a double walled enclosure into which the head or loop of a clothes hanger can be inserted and retained during handling and shipment of the garment box, the double walled enclosure comprising: (i) a first fold over panel integral with a lower surface of the end wall and wherein the first fold over panel comprises; (1) a central, transverse slot, (2) the first panel runs essentially along the entire length of the end wall, so that the length of the first panel is approximately equal to the length of the end wall, (3) a terminal section of the free end of the first panel is adapted to be folded over so as to form a first, longitudinal, spacing wall in the hanger enclosure, (4) a second, square, spacing wall located adjacent to the end of the first panel which is integral with the end wall, the second, square spacing wall being formed as a push out tab by making a smaller slit in the first panel perpendicular to an inner portion of the central, transverse slot, (5) two longitudinal slits on opposite sites of the central, transverse slot, and wherein a protruding tab on the free end of each of a second and a third panel is adapted to be inserted into its corresponding longitudinal slit on the first panel. (ii) a second fold over panel integral with an upper surface of the end wall; (1) the length of the second panel being equal to approximately one half of the length of the end wall, (2) the free end of the second panel bears a protruding tab. (iii) a third fold over panel integral with an upper surface of the end wall and adjacent to the second fold over panel; (1) the length of the third panel being equal to approximately one half of the length of the end wall, (2) the free end of the third panel bears a protruding tab, wherein interposition of the first, second and third fold over panels forms the double walled enclosure and wherein the diameters of both the first and second spacing walls are approximately equal and wherein the spacing walls serve to determine the internal diameter of the hollow of the hanger head enclosure and to assist retention of the shape of the enclosure.

In a further embodiment of a garment box within the scope of the present invention, the double walled enclosure comprises: (a) a first fold over panel integral with a upper surface of the end wall and wherein the first fold over panel has a central, transverse slot, and; (b) a second fold over panel integral with an lower surface of the end wall; (c) a third fold over panel integral with an lower surface of the end wall and adjacent to the second fold over panel, the free end of each of the second and third panels bearing a protruding tab; wherein interposition of the first, second and third fold over panels forms the double walled enclosure, an upper end of the central, longitudinal slot being widened into an insertion port adapted to receive the head of a clothes hanger and wherein the protruding tabs of the second and third panels insert into mating transverse slits of the first panel adjacent to and on opposite side of the insertion port near an upper surface of the double walled enclosure.

The a longitudinal section adjacent to a lower end of the second and third panels can comprise a second push out tab to thereby provide a second square spacing wall.

Also within the scope of the present invention is a method for making a garment box comprising the steps of:

(a) folding up the first fold over panel so that it is parallel to the end wall;

(b) folding down the second fold over panel so that the second fold over panel overlays the first fold over panel and the second fold over panel is parallel to the end wall;

(c) folding down the third fold over panel so that the third fold over panel overlays the first fold over panel and the third fold over panel is parallel to the end wall, thereby forming a doubled walled and hollow, clothes hanger head enclosure.

The method can further comprise the step of folding the terminal section into a position perpendicular to the first fold over wall prior to the step of folding up the first fold over panel so that it is parallel to the end wall, the terminal section serving as a means for spacing the first fold over panel from contact with the end wall, establishing the diameter of the double walled enclosure and for reinforcing the enclosure.

An additional method step can be folding the push out tab into a position perpendicular to the first fold over panel prior to the step of folding up the first fold over panel so that it is parallel to the end wall, the push out tab serving as a further means for spacing the first fold over panel from contact with the end wall, establishing the diameter of the double walled enclosure and for reinforcing the enclosure. And a further method step can be (a) inserting the protruding tab of the second fold over panel into the corresponding longitudinal slit on the first panel after the step of folding down the second fold over panel, and; (b) inserting the protruding tab of the third fold over panel into the corresponding longitudinal slit on the first panel after the step of folding down the third fold over panel.

A detailed method for making a garment box can comprise the steps of:

(a) folding the terminal section into a position perpendicular to the first fold over wall so that it is parallel to the end wall, the terminal section serving as a means for spacing the first fold over panel from contact with the end wall, establishing the diameter of the double walled enclosure and for reinforcing the enclosure;

(b) folding the push out tab into a position perpendicular to the first fold over panel so that it is parallel to the end wall, the push out tab serving as a further means for spacing the first fold over panel from contact with the end wall, establishing the diameter of the double walled enclosure and for reinforcing the enclosure;

(c) folding up the first fold over panel so that it is parallel to the end wall;

(d) folding down the second fold over panel so that the second fold over panel overlays the first fold over panel and the second fold over panel is parallel to the end wall;

(e) inserting the protruding tab of the second fold over panel into the corresponding longitudinal slit on the first panel;

(f) folding down the third fold over panel so that the third fold over panel overlays the first fold over panel and the third fold over panel is parallel to the end wall, thereby forming a doubled walled and hollow, clothes hanger head enclosure, and;

(g) inserting the protruding tab of the third fold over panel into the corresponding longitudinal slit on the first panel.

DRAWINGS

These and other features, aspects, and advantages of the present invention can become better understood from the following description, claims and the accompanying drawings where:

DESCRIPTION

The present invention is based upon the discovery that a garment box wherein clothing can be held securely on clothes hangers and shipped in the box without the clothing coming off the hangers, the hangers coming loose and intermingling and without the clothes hanger heads having opportunity to get caught on or to tear the secured in place clothing can be constructed by making a box which has an internal clothes hanger head enclosure which clothes hanger head enclosure has a double inner wall formed from the interlocking action of three fold over panels and two or more bulwark or spacing walls in the hollow of the clothes hanger head enclosure, which spacing walls assist retention of the shape and integrity of the clothes hanger head enclosure during handling and shipment of the garment box.

At least one end wall of the garment box is provided with an interior, hollow, double walled clothes hanger head enclosure foldably connected thereto and having a central, transverse slot disposed in a spaced relationship from the end wall of the garment box. The slot is adapted to accommodate the head or loop of a clothes hanger, subsequent to which the top panels of the garment box are closed and the garment box is sealed ready for shipment.

Figure 1:
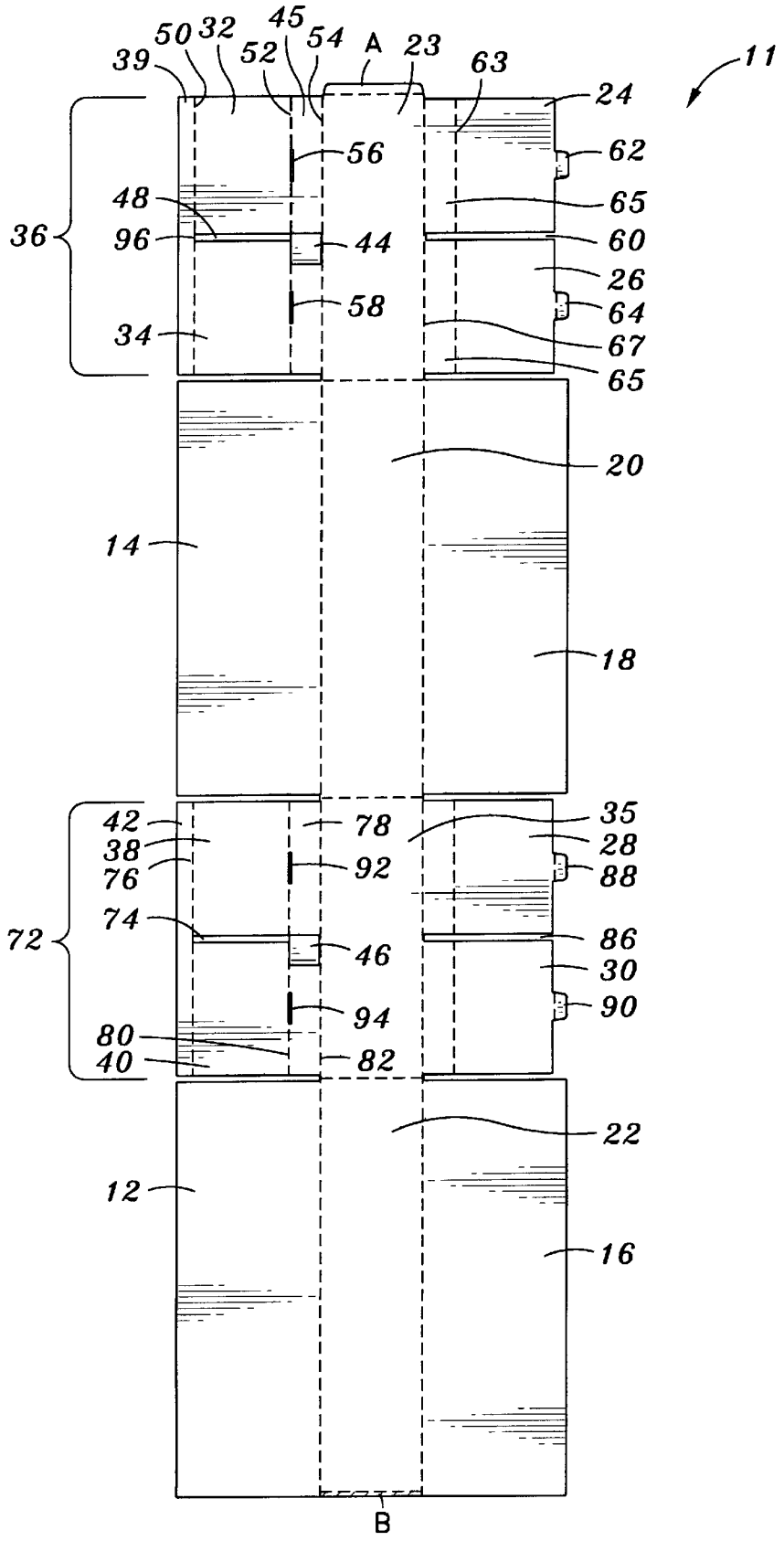
FIG. 1 is a top plan view of one form of a blank used to make a garment box within the scope of the present invention.

An embodiment within the scope of the present invention can be a garment box 10 (see FIG. 5) which is made by carrying out a specific sequence of folding steps upon a garment box blank 11 (see FIG. 1). The garment box blank 11 is folded along appropriate fold and crease lines and certain panels thereby formed by the folding operation are brought into proximity or juxtaposition to other panels or are made to abut or to interlock into other panels of the garment box blank 11.

For illustrative convenience, the garment box blank 11 of FIG. 1, is shown as a single flat item. In actuality, the tab A is adhered to or during the box blank manufacturing process is made integral with the area B prior to the carrying out of the specific sequence of folding steps the result of which is to make the garment box 10 out of the garment box blank 11.

The garment box 10 has a top wall, a bottom wall, two side walls and two end walls. The bottom wall of the garment box 10 is formed by the juxtaposition of two foldable, bottom wall panels 12 and 14. The top wall is of the garment box 10 similarity formed by the juxtaposition of two foldable, top wall panels 16 and 18. The side walls 20 and 22 are on opposite sides of the garment box 10. The side wall 20 is contiguous with and integral with the top panel 18 and the bottom panel 14, while the side wall 22 is contiguous with and integral with the top panel 16 and the bottom panel 12. Thus, the two side walls 20 and 22 are disposed between and spacing apart the bottom wall panels and the top wall panels.

The garment box 11 further comprises two end walls 23 and 35. The end wall 23 is adjacent to and at right angles to one end of the side walls 20 and 22 , while the other end wall 35 is adjacent to and at right angles to the opposite end of the side walls 20 and 22.

Importantly, at least one of the end walls 23 or 35 is parallel to and contiguous with a double walled enclosure 37 in which double walled enclosure there can be secured the heads of a plurality of clothes hangers. In a preferred embodiment of the garment box 10, both of the end walls 23 and 35 are parallel to and contiguous with a double walled enclosure 37 and 70 in which double walled enclosure there can be secured the head of a plurality of clothes hangers. This embodiment is preferred because it permits an alternate layering arrangement of clothing within the garment box and this arrangement which facilitates a wrinkle free, non-slippage shipment of clothing within the garment box 10. I have found that in the specified preferred embodiment with such an alternate layering of clothing in the garment box 10 on clothes hangers, because the clothes hangers are also arranged in an alternate layering pattern, that this arrangement provides a significant and desirable impediment to movement or jostling which would permit the clothes hanger heads from working themselves free of the double walled enclosure in which they are secured at the time of packing the garment box 10 with clothing on clothes hangers. Thus, at each end of the garment box 10 the internal garment box 10 arrangement with the preferred second embodiment is clothes hanger, clothing, clothes hanger, clothing, etc.

The double walled enclosure is a reinforced and supported hollow enclosure and is a crucial and very important aspect of the present invention. The double walled enclosure serves as an enclosure for securely holding in place during handling and shipment the heads of a plurality of clothes hangers. The clothes hangers, bearing clothing, are packed into the garment box 10 and the clothing are shipped in the garment box 10. It is important to note that the double wall of the double walled enclosure extends for the full length of the doubled walled enclosure parallel to the end wall 23 between the two side walls 20 and 22 of the garment box 10. In other words, the double wall is not present only in the vicinity of the slot for receiving the clothes hanger heads.

The double walled enclosure 37 comprises a first fold over panel 36 which is integral with a lower surface of the end wall 23. The first fold over panel 36 is comprised of four distinct portions or sections: (1) panel sections 32 and 34, which are separated by a slit 48; (2) a reinforcing wall 39 which runs the length of one outer end of the panels 32 and 34. The reinforcing or spacing wall 39 is a terminal, longitudinal section formed by folding along crease 50 and functions as a first, longitudinal, spacing wall within the hollow of the hanger head enclosure 37; (3) a panel section 45 formed by folding along crease lines 52 and 54. The panel section 45 forms the bottom wall of the double walled hanger head enclosure 37, and; (4) a push out tab 44, in panel section 45, functions as a reinforcing or spacing wall to help maintain the integrity of the internal dimension of the hanger head enclosure 37. The push out tab 44 is a square, spacing wall, formed by making a smaller slit in the panel section 45 perpendicular to an inner portion of the central, transverse slit 48.

The double walled hanger head enclosure 37 also has second and third fold over panels 24 and 26 which panels are integral with an upper surface of the end wall 23. The second fold over panels 24 and the third fold over panel 26 are both folded down after the first panel 36 is folded up, so that the second and third panels 24 and 26 overlay the first panel 36, to thereby form the doubled walled enclosure wherein the first fold over panel 36 forms a first, inner wall of the doubled wall enclosure 37 and the first and third fold over panels 24 and 26 form a second outer wall of the double walled enclosure 37. It is important to note that the three panels 36, 24 and 26 fold onto each other along and parallel to the end wall 23 of the garment box 10.

The second and third panels 24 and 26 are preferably equal in size and the spacing provided by the slit 60 between the second and third panels is approximately equal to the diameter of the central, transverse slit 48. Each free end of each of the second and third panels 24 and 26 can bear a protruding tab 62 and 64, respectively.

The short axis dimension of both the reinforcing wall 39 and the spacing wall 44 are approximately equal and serve to determine the internal dimension (short axis width) of the hanger head enclosure 37 and assist retention of the shape of the enclosure 37 during handling and transport of the garment box 10.

The protruding tabs 62 and 64 on the free end of respectively second panel 24 and third panels 62 are adapted to be inserted into a corresponding longitudinal slit 56 and 58 respectively, located along the crease line 52 and on opposite sites of the central transverse slit 48.

In a preferred embodiment of the garment box 10, a second double walled hanger head enclosure 70 is present at the second end 35 of the garment box 10. The second hanger head enclosure 70 is constructed similarly to the hanger head enclosure 37. Thus, the double wall of the double walled enclosure 70 extends for the full length of the doubled walled enclosure parallel to the end wall 35 between the two side walls 20 and 22 of the garment box 10. In other words, the double wall is not present only in the vicinity of the slot for receiving the clothes hanger heads.

The double walled enclosure 70 comprises a first fold over panel 72 which is integral with a lower surface of the end wall 35. The first fold over panel 72 is comprised of four distinct portions or sections: (1) panel sections 38 and 40, which are separated by a slit 74; (2) a reinforcing wall 42 which runs the length of one outer end of the panel sections 38 and 40. The reinforcing or spacing wall 42 is a terminal, longitudinal section formed by folding along crease line 76 and functions as a first, longitudinal, spacing wall within the hollow of the hanger head enclosure 70; (3) a panel section 78 formed by folding along crease lines 80 and 82. The panel section 78 forms the bottom wall of the double walled hanger head enclosure 70, and; (4) a push out tab 46, in panel section 78, functions as a reinforcing or spacing wall to help maintain the integrity of the internal dimension of the hanger head enclosure 70. The push out tab 46 is a square, spacing wall, formed by making a smaller slit in the panel section 78 perpendicular to an inner portion of the central, transverse slit 74.

The double walled hanger head enclosure 70 also has second and third fold over panels 28 and 30 which panels are integral with an upper surface of the end wall 35. The second fold over panel 28 and the third fold over panel 30 are both folded down after the first panel 72 is folded up, so that the second and third panels 28 and 30 overlay the first panel 72, to thereby form the doubled walled enclosure 70 wherein the first fold over panel 72 forms a first, inner wall of the doubled wall enclosure 37 and the second and third fold over panels 28 and 30 form a second outer wall of the double walled enclosure 70. It is important to note that the three panels 72, 28 and 30 fold onto each other along and parallel to the end wall 35 of the garment box 10.

The second and third panels 28 and 30 are preferably equal in size and the spacing provided by the slit 86 between the second and third panels is approximately equal to the diameter of the central, transverse slot 74. Each free end of each of the second and third panels 28 and 30 can bear a protruding tab 88 and 90, respectively.

The short axis diameters of both the reinforcing wall 42 and the spacing wall 46 are approximately equal and serve to determine the internal diameter (short axis width) of the hanger head enclosure 70 and assist retention of the shape of the enclosure 70 during handling and transport of the garment box 10.

The protruding tabs 88 and 90 on the free end of respectively second panel 28 and third panel 30 are adapted to be inserted into a corresponding longitudinal slit 92 and 94 respectively, located along the crease line 80 and on opposite sites of the central transverse slot 74.

Figure 5:
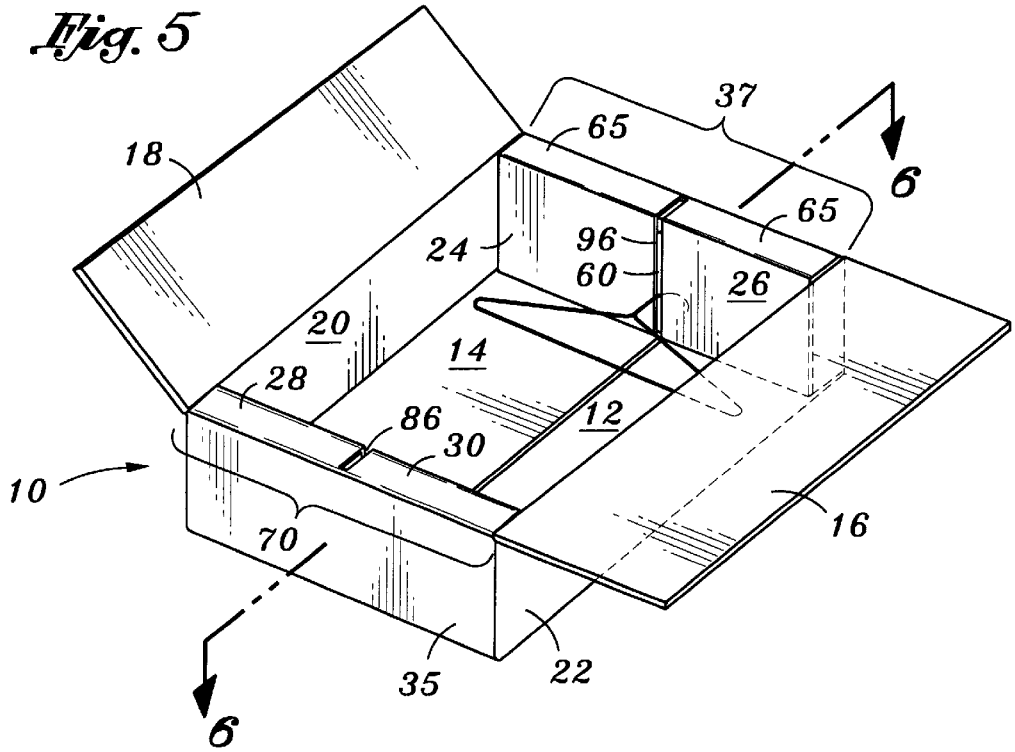
FIG. 5 is a perspective, assembled view of the garment box with the top panels left open and showing the head of a clothes hanger secured with the clothes hanger head enclosure.
Figure 6:
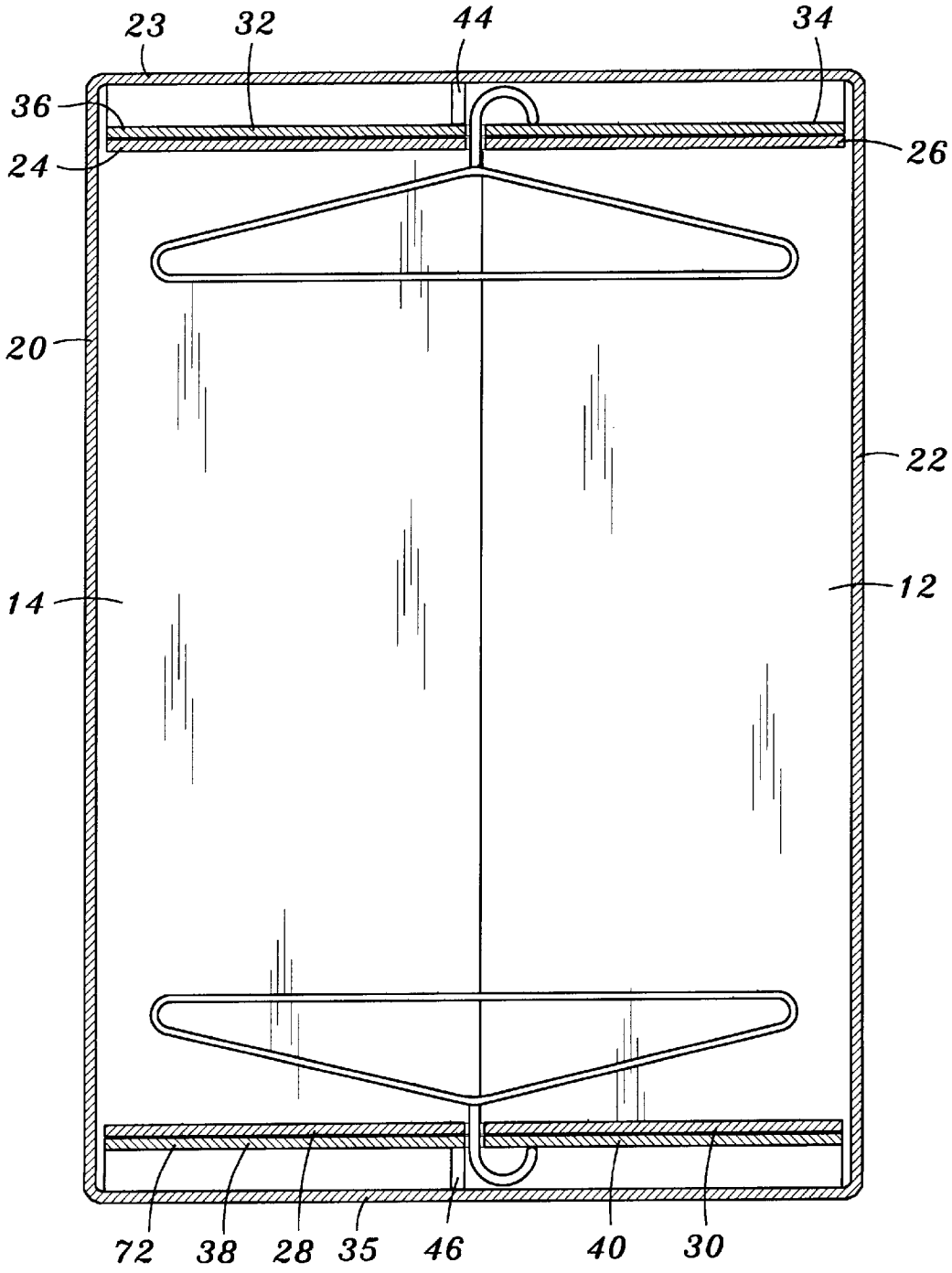
FIG. 6 is a cross sectional view taken along the line 6—6 in FIG. 5.

In the embodiments described above the head of a clothes hanger is inserted into the slot 48 or the slot 74 and then twisted about 90 degrees so that the clothes hanger will lie flat within the garment box 10, as shown by FIG. 5. Movement of the clothes hanger head upwards and out of the slot 48 is prevented because the upper end of the slot 48 is closed by reinforcing wall 39, just as the upper end of slot 74 is closed by the reinforcing wall 42. As shown best by FIG. 5 with regard to the double walled enclosure 37, the slot 48 is closed at its upper end at the location 96.

Figure 2:
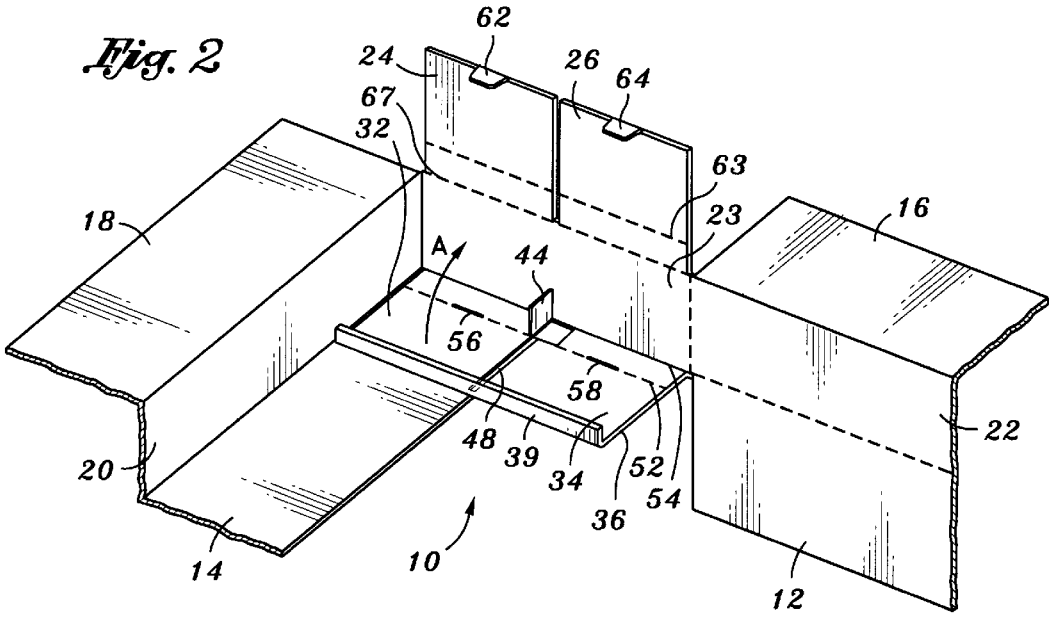
FIG. 2 is a perspective, partially assembled, cut away view of the garment box using the blank shown in FIG. 1.
Figure 3:
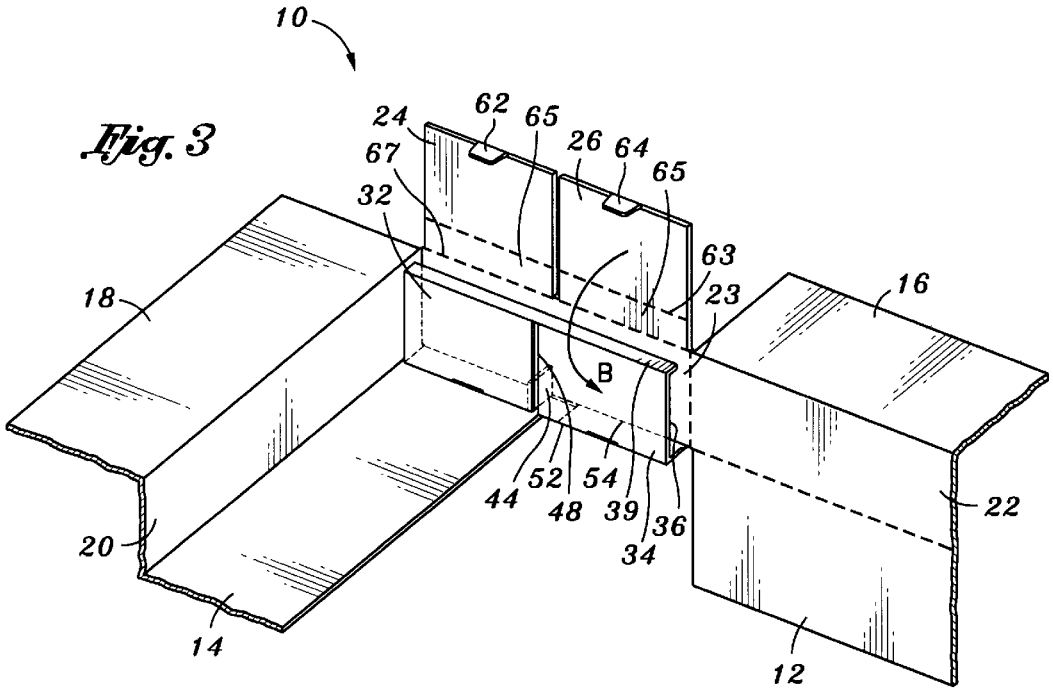
FIG. 3 is a perspective, partially assembled, cut away view of the garment box using the blank shown in FIG. 1, showing an assembly step subsequent to the step shown in FIG. 2.
Figure 4:
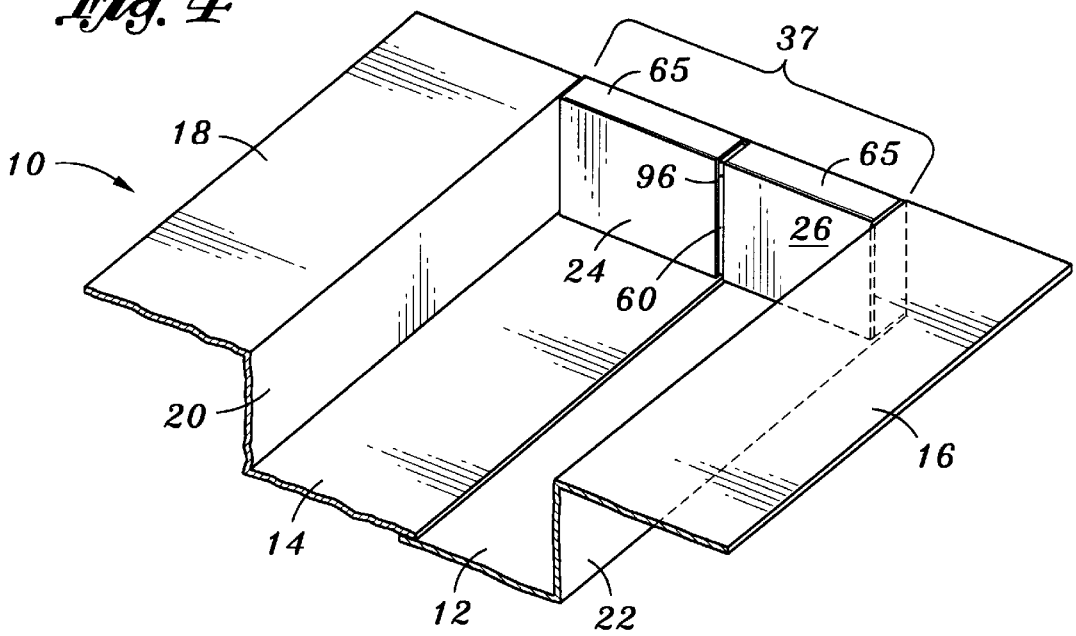
FIG. 4 is perspective, assembled, cut away view of the garment box with the top panels left open.
Figure 7:
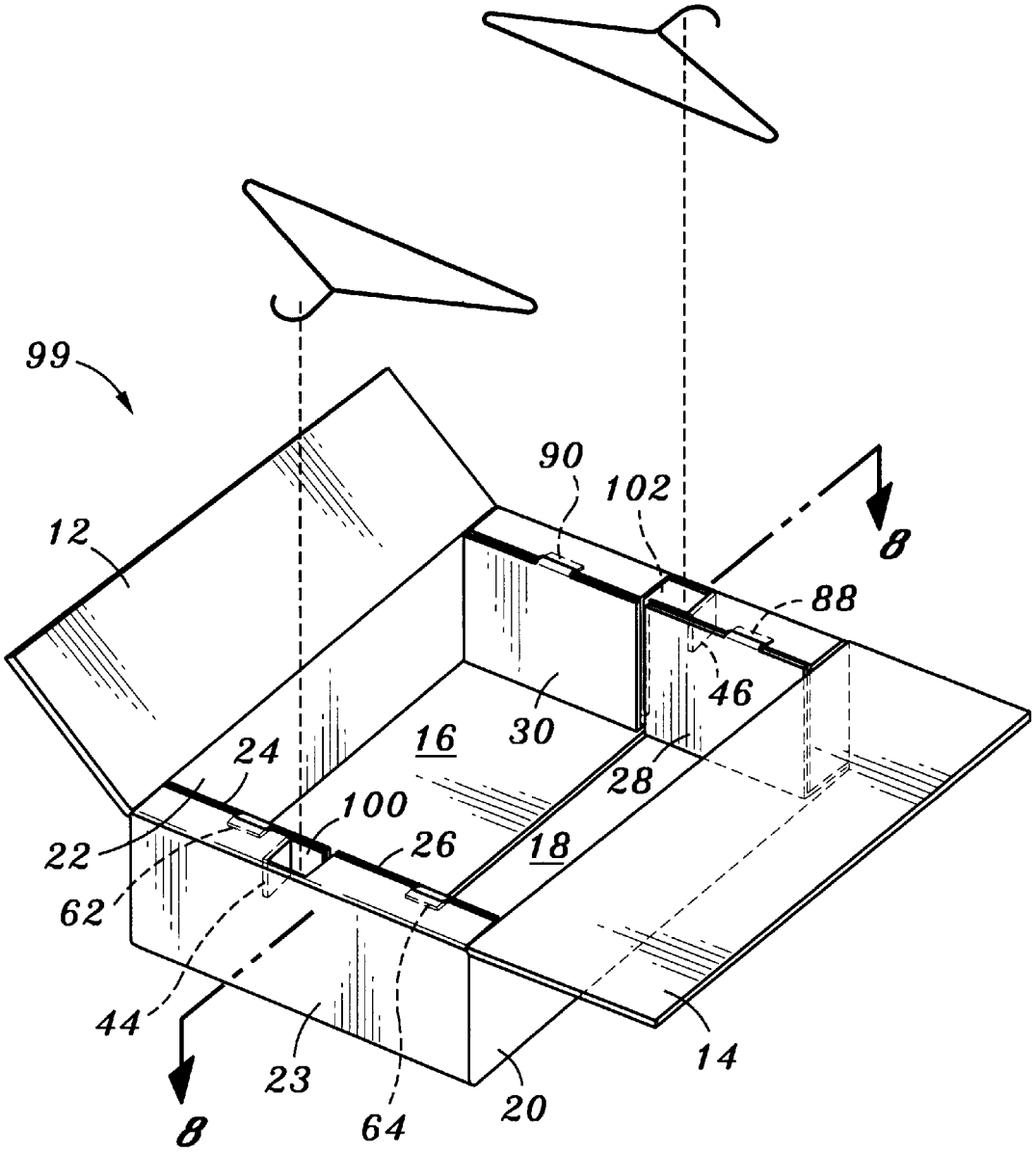
FIG. 7 is a perspective, assembled view of a second embodiment within the scope of the present invention formed by reversing the top and bottom positions of the FIG. 1 embodiment.
Figure 8:
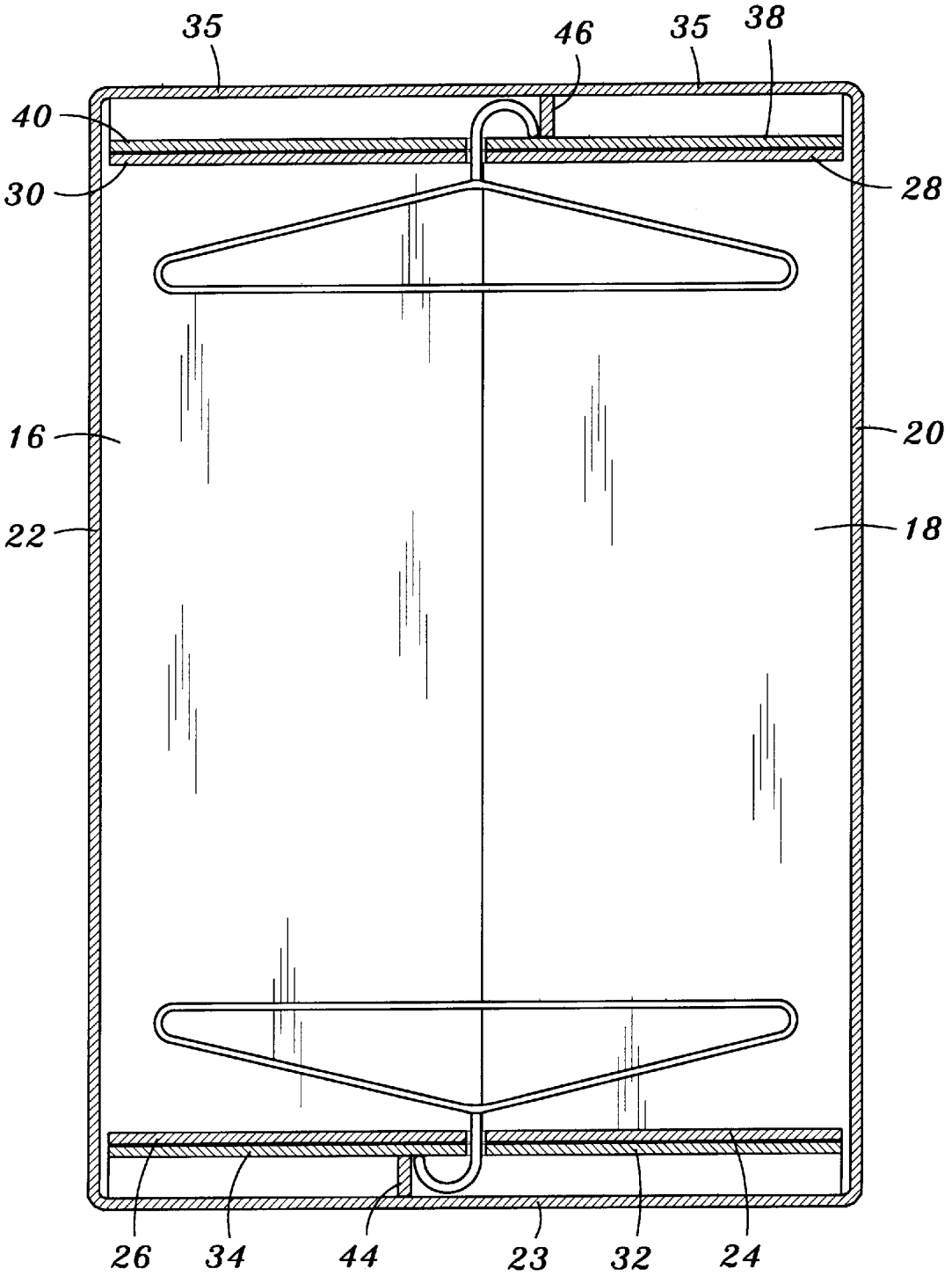
FIG. 8 is a cross sectional view taken along the line 8—8 in FIG. 7.

As shown best by FIG. 2, the enclosure 37 can be made by folding up panel 36 in the direction shown by arrow A in FIG. 2. Subsequently, panels 24 and 26 are folded down in the direction shown by arrow B in FIG. 2. Panels 24 and 26 are folded along crease 63 so that area 65 which is between the crease lines 63 and 65 forms a top wall of the enclosure 37. In all the Figures the dotted lines represent crease or fold lines FIGS. 7 and 8 illustrate a third embodiment 99 of present invention. This embodiment is made by turning the garment box 10 upside down, so that panels 12 and 14 become the top panels and panels 16 and 18 become the bottom panels of the garment box 10. In this embodiment, hanger head enclosures 37 and 70 are still double walled enclosures with (for enclosure 37) first panel 36 on the inside and second and third panels 24 and 26 on the outside of the double walled enclosure. Note though, that with this embodiment tabs 60 and 64 insert into slit 56 and 58 at the upper end of the enclosure 37. This third embodiment, as shown by FIG. 7, permits the heads of clothes hangers to be inserted into the openings 100 and 102 formed by the extension of push out tabs or spacing walls 44 and 46, respectively. Once the clothes hangers are in place, top panels 14 and 16 are closed, thereby sealing the openings 100 and 102.

Figure 9:
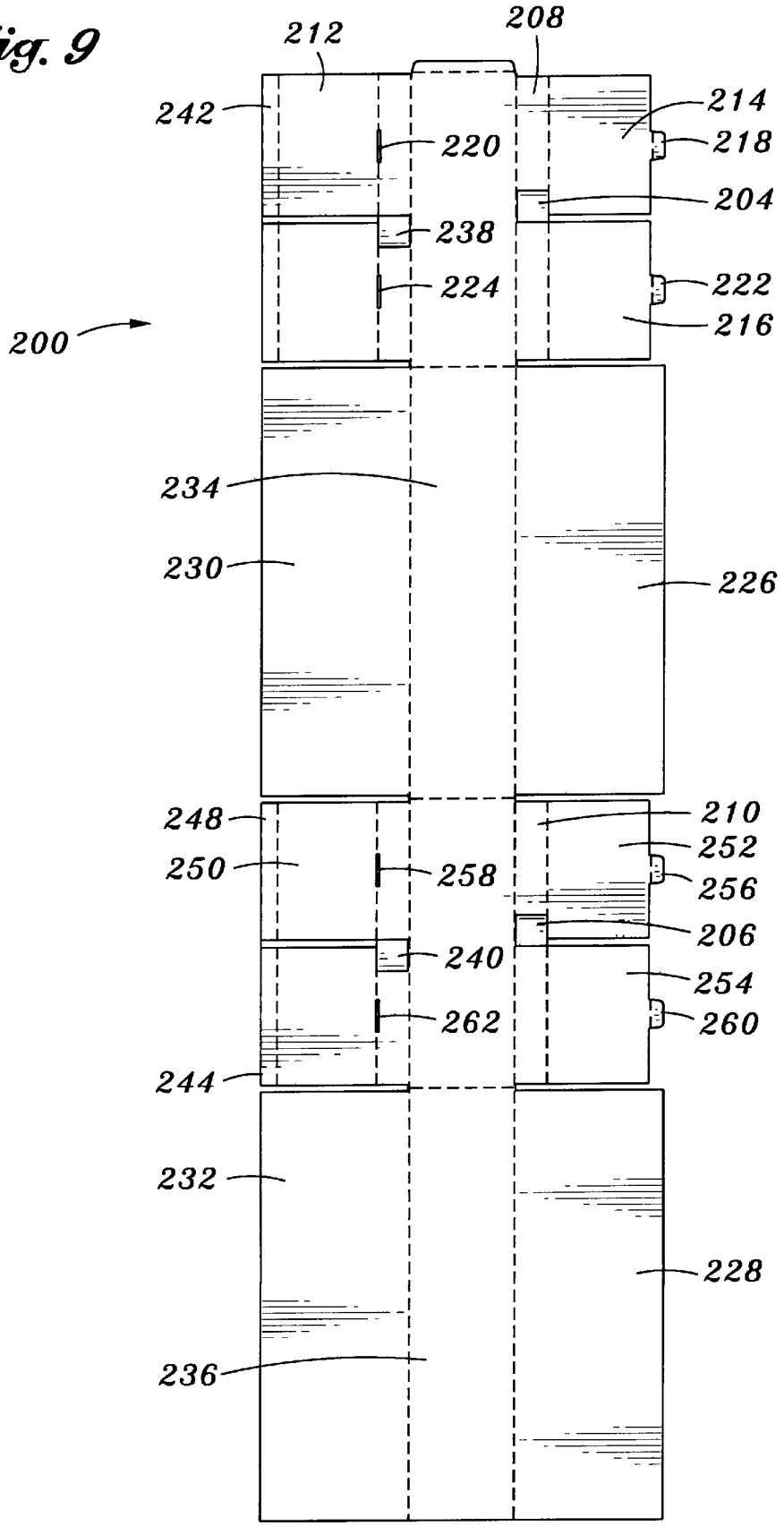
FIG. 9 is a top plan view of second form of a blank used to make a third embodiment of a garment box within the scope of the present invention.

FIG. 9 illustrates a garment box blank of a fourth embodiment 200 of the present invention wherein third and fourth spacing walls 204 and 206 are provided in, respectively, panel sections 208 and 210. First and second spacer walls 238 and 240 are also provided as in earlier embodiments. The FIG. 9 garment box blank has the elements of a first hanger head enclosure, at one end of the garment box, comprising a first fold over panel 212 and second and third fold over panels 214 and 216. Tab 218 fits into slot 220 and tab 222 fits in slot 224. Panels 226 and 228 form the top panels of the garment box and panels 230 and 232 form the bottom panels of the garment box. Areas 234 and 236 form the side wall of the assembled garment box. As in earlier embodiments reinforcing walls 242 and 244 are provided.

The second hanger head enclosure at the other end of the garment box in this embodiment similarly has the elements of a first fold over panel 250 and second and third fold over panels 252 and 254. Tab 256 fits into slot 258 and tab 260 fits into slot 262.

The invention from the exterior appears to be a typical, shipping strength, cardboard box with dimensions of about 30" long, 19" wide and 8" deep, although the exterior dimension are not limiting.

Figure 10:
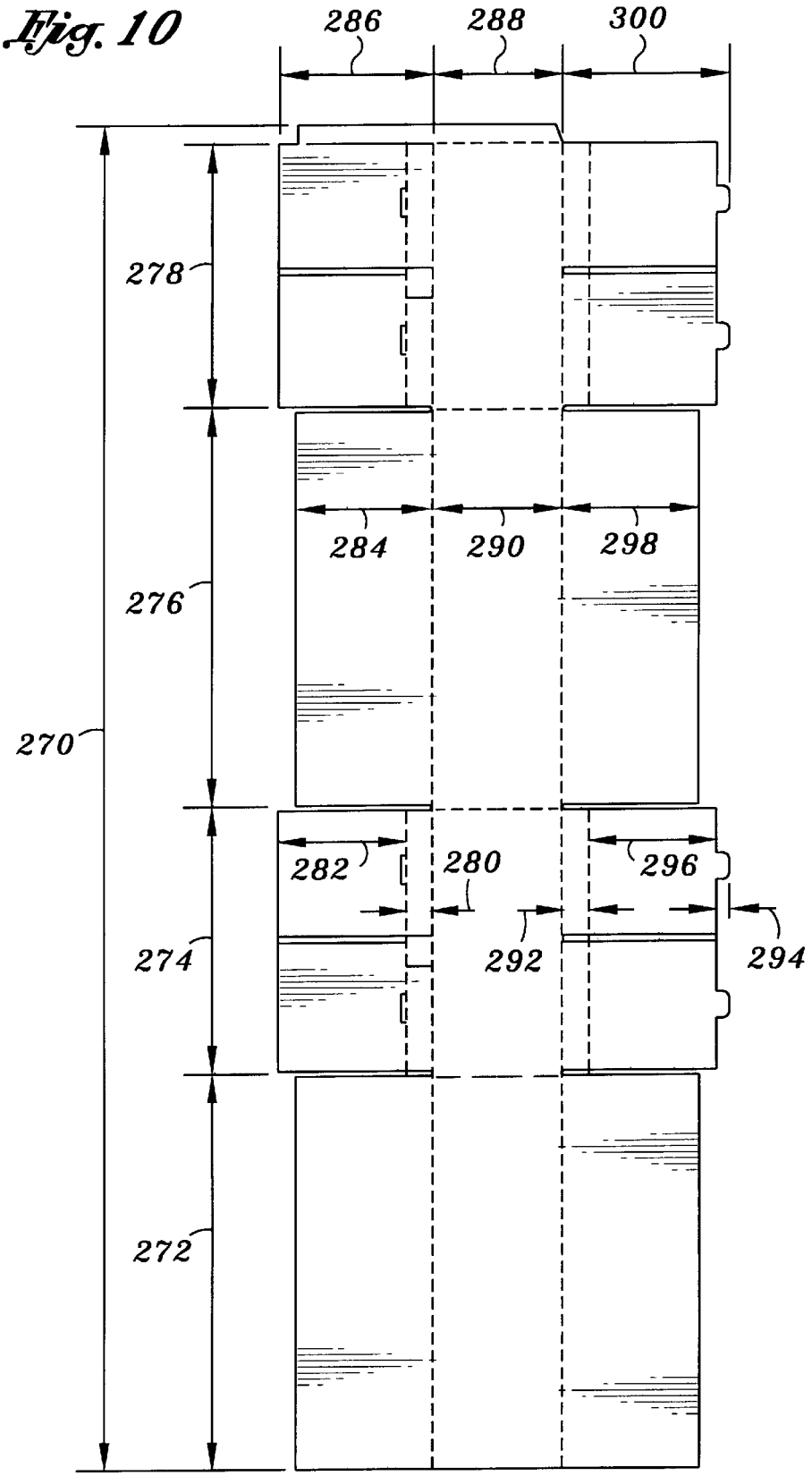
FIG. 10 is a top plan view of a preferred embodiment of the invention shown in FIG. 1 with the dimensions of various elements of the garment box blank shown in FIG. 10 set forth in inches.

The numerals in FIG. 10 have the following meaning. Numeral 270 represents a dimension of 101 and ⅝ inches. Numeral 270 represents a dimension of 101 and ⅝ inches. Numeral 272 represents a dimension of 30 inches. Numeral 274 represents a dimension of 20 and ⅛ inches. Numeral 276 represents a dimension of 30 and ⅛ inches. Numeral 278 represents a dimension of 20 and ⅛ inches. Numeral 280 represents a dimension of 1 and ⅞ inches. Numeral 282 represents a dimension of 9 and ¼ inches. Numeral 284 represents a dimension of 10 and ⅛ inches. Numeral 286 represents a dimension of 11 and ⅛ inches. Numeral 288 represents a dimension of 9 and ⅜ inches. Numeral 290 represents a dimension of 9 and ⅜ inches. Numeral 292 represents a dimension of 2 inches. Numeral 294 represents a dimension of ⅞ inches. Numeral 296 represents a dimension of 9 and ¼ inches. Numeral 298 represents a dimension of 10 and ¼ inches and numeral 300 represents a dimension of 12 and ⅛ inches.

A garment box according to the invention disclosed herein has many advantages, including the following:

1. it can securely retain the head or loop of a clothes hanger head in place during handling and shipment.
2. it can be turned upside down to provide an additional garment box embodiment.
3. It can have one or two double walled hanger head enclosures Although the present invention has been described in detail with regard to certain preferred methods, other embodiments, versions, and modifications within the scope of the present invention are possible. For example, a wide variety of hanger head enclosure configurations are possible.

Accordingly, the spirit and scope of the following claims should not be limited to the descriptions of the preferred embodiments set forth above.

I claim:

1. A garment box, comprising:

(a) a bottom wall formed by the juxtaposition of two foldable, bottom wall panels;

(b) a top wall formed by the juxtaposition of two foldable, top wall panels;

(c) two side walls disposed between and spacing apart the bottom wall and the top wall, and;

(d) two end walls, each end wall being adjacent to and at right angles to the side walls and wherein, parallel to and contiguous to at least one of the end walls, there is a double walled enclosure with a slot into which the head or loop of a clothes hanger can be inserted and retained during handling and shipment of the garment box wherein the double walled enclosure comprises:

(a) a first fold over panel integral with a lower surface of the end wall and wherein the first fold over panel has a central, transverse slot;

(b) a second fold over panel integral with an upper surface of the end wall, and;

(c) a third fold over panel integral with an upper surface of the end wall and adjacent to the second fold over panel, wherein interposition of the first, second and third fold over panels forms the double walled enclosure, wherein:

(a) the first panel runs essentially along the entire length of the end wall, so that the length of the first panel is approximately equal to the length of the end wall;

(b) the length of the second panel is equal to approximately one half of the length of the end wall, and;

(c) the length of the third Panel is equal to approximately one half of the length of the end wall, and wherein the free end of each of the second and third panels bears a protruding tab.

2. The garment box of claim 1, wherein a terminal section of the free end of the first panel is adapted to be folded over so as to form a first, longitudinal, spacing wall in the hanger enclosure.

3. The garment box of claim 2, wherein the first panel further comprises a second square spacing wall located adjacent to the end of the first panel which is integral with the end wall, the second square spacing wall being formed as a push out tab by making a smaller slit in the first panel perpendicular to an inner portion of the central, transverse slot.

4. The garment box of claim 3, wherein the diameters of both the first and second spacing walls are approximately equal and wherein the spacing walls serve to determine the internal dimension of the hollow of the hanger head enclosure and to assist retention of the shape of the enclosure.

5. The garment box of claim 4, wherein the first panel has two longitudinal slits on opposite sites of the central transverse slot, and wherein the protruding tab on the free end of each of the second and third panels is adapted to be inserted into its corresponding longitudinal slit on the first panel.

6. The garment box of claim 1, wherein interposition of the first, second and third fold over panels forms the double walled enclosure, an upper end of the central longitudinal slot being widened into an insertion port adapted to receive the head of a clothes hanger and wherein the protruding tabs of the second and third panels insert into mating transverse slits of the first panel adjacent to and on opposite side of the insertion port near an upper surface of the double walled enclosure.

7. The garment box of claim 6, wherein a longitudinal section adjacent to a lower end of the second and third panels comprises a second push out tab to thereby provide a second square spacing wall.

8. A method for making a garment box wherein the garment box comprises: a first fold over panel which has two ends, a free end and an opposite end integral with a lower surface of an end wall of the garment box, and wherein the first fold over panel has a central transverse slot and the first fold over panel further comprises along the length of its free end a longitudinal, terminal section and a push out tab adjacent to the end of the first fold over panel with is integral with the end wall of the garment box; a second fold over panel integral with an upper surface of the end wall, and; a third fold over panel integral with an upper surface of the end wall and adjacent to the second fold over panel, wherein the free end of each of the second and third panels bears a protruding tab and wherein the first panel has two longitudinal slits on opposite sites of the central transverse slit, the method comprising the steps of:

(a) folding the terminal section into a position perpendicular to the first fold over wall so that it is parallel to the end wall, the terminal section serving as a means for spacing the first fold over panel from contact with the end wall, establishing the diameter of the double walled enclosure and for reinforcing the enclosure;

(b) folding the push out tab into a position perpendicular to the first fold over panel so that it is parallel to the end wall, the push out tab serving as a further means for spacing the first fold over panel from contact with the end wall, establishing the diameter of the double walled enclosure and for reinforcing the enclosure;

(c) folding up the first fold over panel so that it is parallel to the end wall;

(d) folding down the second fold over panel so that the second fold over panel overlays the first fold over panel and the second fold over panel is parallel to the end wall;

(e) inserting the protruding tab of the second fold over panel into the corresponding longitudinal slit on the first panel;

(f) folding down the third fold over panel so that the third fold over panel overlays the first fold over panel and the third fold over panel is parallel to the end wall, thereby forming a doubled walled hollow clothes hanger head enclosure, and;

(g) inserting the protruding tab of the third fold over panel into the corresponding longitudinal slit on the first panel.

9. A garment box, comprising:

(a) a bottom wall formed by the juxtaposition of two foldable bottom wall panels;

(b) a top wall formed by the juxtaposition of two foldable top wall panels;

(c) two side walls disposed between and spacing apart the bottom wall and the top wall, and;

(d) two end walls, each end wall being adjacent to and at right angles to the side walls and wherein parallel to and contiguous to at least one of the end walls there is disposed;

(e) a double walled enclosure with a slot into which the head or loop of a clothes hanger can be inserted and retained during handling and shipment of the garment box, the double walled enclosure comprising:

(i) a first fold over panel integral with a lower surface of the end wall and wherein the first fold over panel comprises;

(1) a central transverse slot, (2) the first panel runs essentially along the entire length of the end wall, so that the length of the first panel is approximately equal to the length of the end wall, (3) a terminal section of the free end of the first panel is adapted to be folded over so as to form a first longitudinal spacing wall in the hanger enclosure, (4) a second square spacing wall located adjacent to the end of the first panel which is integral with the end wall, the second square spacing wall being formed as a push out tab by making a smaller slit in the first panel perpendicular to an inner portion of the central, transverse slot, (5) two longitudinal slits on opposite sites of the central transverse slot, and wherein a protruding tab on the free end of each of a second and a third panel is adapted to be inserted into its corresponding longitudinal slit on the first panel (ii) a second fold over panel integral with an upper surface of the end wall;

(1) the length of the second panel being equal to approximately one half of the length of the end wall, (2) the free end of the second panel bears a protruding tab.

(iii) a third fold over panel integral with an upper surface of the end wall and adjacent to the second fold over panel;

(1) the length of the third panel being equal to approximately one half of the length of the end wall, (2) the free end of the third panel bears a protruding tab.

wherein interposition of the first, second and third fold over panels forms the double walled enclosure and wherein the dimensions of both the first and second spacing walls are approximately equal and wherein the spacing walls serve to determine the internal dimension of the hollow of the hanger head enclosure and to assist retention of the shape of the enclosure.

10. A method for making a garment box wherein the garment box comprises: a first fold over panel which has two ends, a free end and an opposite end integral with a lower surface of an end wall of the garment box, and wherein the first fold over panel has a central transverse slot; a second fold over panel integral with an upper surface of the end wall, and; a third fold over panel integral with an upper surface of the end wall and adjacent to the second fold over panel, the method comprising the steps of:

(a) folding up the first fold over panel so that it is parallel to the end wall;

(b) folding down the second fold over panel so that the second fold over panel overlays the first fold over panel and the second fold over panel is parallel to the end wall;

(c) folding down the third fold over panel so that the third fold over panel overlays the first fold over panel and the third fold over panel is parallel to the end wall, thereby forming a doubled walled hollow clothes hanger head enclosure, wherein the first fold over panel further comprises along the length of its free end a longitudinal terminal section, the method further comprising the step of folding the terminal section into a position perpendicular to the first fold over wall prior to the step of folding up the first fold over panel so that it is parallel to the end wall, the terminal section serving as a means for spacing the first fold over panel from contact with the end wall, establishing the dimension of the double walled enclosure and for reinforcing the enclosure, and;

wherein the first fold over panel further comprises a push out tab adjacent to the end of the first fold over panel with is integral with the end wall of the garment box, the method comprising the step of folding the push out tab into a position perpendicular to the first fold over panel prior to the step of folding up the first fold over panel so that it is parallel to the end wall, the push out tab serving as a further means for spacing the first fold over panel from contact with the end wall, establishing the dimension of the double walled enclosure and for reinforcing the enclosure.

11. The method of claim 10, wherein the free end of each of the second and third panels bears a protruding tab and wherein the first panel has two longitudinal slits on opposite sites of the central transverse slit, the method comprising the further steps of:

(a) inserting the protruding tab of the second fold over panel into the corresponding longitudinal slit on the first panel after the step of folding down the second fold over panel, and;

(b) inserting the protruding tab of the third fold over panel into the corresponding longitudinal slit on the first panel after the step of folding down the third fold over panel.

* * * * *